US005534178A

United States Patent [19]

Bailly et al.

[11] Patent Number: 5,534,178

[45] Date of Patent: Jul. 9, 1996

[54] PERFORATED, STABLE, WATER SOLUBLE FILM CONTAINER FOR DETERSIVE COMPOSITIONS

[75] Inventors: Helen Bailly, Eagan; Arthur Luedtke, Woodbury; Paul Pankratz, Lakeville; Joy Allen, Jordan; Tina O. Outlaw, Inver Grove Heights; Lance K. Fisher, Excelsior; Kelvin D. Sundeen, Eagan, all of Minn.

[73] Assignee: Ecolab Inc., St. Paul, Minn.

[21] Appl. No.: 354,379

[22] Filed: Dec. 12, 1994

[51] Int. Cl.[6] ..... C11D 17/00

[52] U.S. Cl. ..... 510/367; 510/439; 510/379; 510/380; 510/381; 510/220; 510/224; 510/225; 510/296

[58] Field of Search ..... 252/90, 91, 93, 252/174, 174.23, 95, 156, 142, DIG. 16

[56] References Cited

U.S. PATENT DOCUMENTS

| | | | |
|---|---|---|---|
| Re. 32,818 | 1/1989 | Fernholz et al. | 252/90 |
| 3,198,740 | 8/1965 | Dunlop | 252/90 |
| 3,471,597 | 10/1969 | Schirmer | 264/25 |
| 3,741,724 | 6/1973 | Harmon | 8/115.5 |
| 3,750,237 | 8/1973 | Kalwaites | 19/161 P |
| 3,892,905 | 7/1975 | Albert | 428/220 |
| 3,930,086 | 12/1975 | Harmon | 428/131 |
| 3,944,694 | 3/1976 | McQueary | 428/131 |
| 3,956,556 | 5/1976 | McQueary | 428/131 |
| 4,025,752 | 5/1977 | Whitman III | 219/384 |
| 4,155,971 | 5/1979 | Wysong | 260/204 |
| 4,220,562 | 9/1980 | Spadini et al. | 252/542 |
| 4,349,531 | 9/1982 | Mlodozeniec et al. | 414/27 |
| 4,448,699 | 5/1984 | Barrat et al. | 252/8.75 |
| 4,619,779 | 10/1986 | Hardy | 252/91 |
| 4,743,123 | 5/1988 | Legeters et al. | 383/103 |
| 4,970,553 | 11/1990 | Orlowski et al. | 355/200 |
| 5,078,301 | 1/1992 | Gladfelter et al. | 222/52 |
| 5,175,043 | 12/1992 | Yabe et al. | 428/156 |
| 5,198,198 | 3/1993 | Gladfelter et al. | 422/264 |
| 5,262,132 | 11/1993 | Bricker et al. | 422/263 |

FOREIGN PATENT DOCUMENTS

| | | |
|---|---|---|
| 0003769 | 9/0979 | European Pat. Off. . |
| 1368126 | 2/1963 | France . |

*Primary Examiner*—Paul Lieberman
*Assistant Examiner*—Lorna M. Douyon
*Attorney, Agent, or Firm*—Merchant, Gould, Smith, Edell, Welter & Schmidt

[57] ABSTRACT

Uniform, microscopic perforated water soluble film is herein described, and its use in packaging solid, pelletized or particulate detersire compositions containing strong acids, strong bases or a source of halogen whereby the package provides air to pass through without leakage of its contents. Also described is a method of manufacture of a sealed, water soluble, detersire package with microscopic perforations and an apparatus for said manufacture.

20 Claims, 3 Drawing Sheets

VARIABLE VOLTAGE INPUT
51
VOLTAGE SUPPLY AND REGULATOR
50
TIMING BLOCK
52
CDI MODULE NO.1
53a
CDI MODULE NO.2
53b
CDI MODULE NO.3
53c
CDI MODULE NO.4
53d
CDI MODULE NO.5
53e
COIL NO.1
54a
COIL NO.2
54b
COIL NO.3
54c
COIL NO.4
54d
COIL NO.5
54e
45
41
42
21
20

PERFORATED, STABLE, WATER SOLUBLE FILM CONTAINER FOR DETERSIVE COMPOSITIONS

FIELD OF THE INVENTION

The invention relates to stable, water soluble containers made from water soluble films which have uniform microscopic perforations. The containers are used for dispensing cast solid, pelletized or particulate detersire compositions in industrial or household cleaning operations. Detersive compositions are mixtures of chemicals that can remove impurities, dirt or a soil from a surface or fabric.

BACKGROUND OF THE INVENTION

The art relating to water soluble polymeric films recognizes the use of the films in packaging. The primary commercial use of such packages has been in household applications in which pre-measured quantities of detergent materials can be packaged in water-soluble films for ease of use. Soluble packaging can also eliminate problems concerned with dusting and human contact with dust which can cause chemical attack and/or irritation of human skin and eyes and can cause other problems upon ingestion or inhalation (see U.S. Pat. No. 3,198,740).

For industrial purposes, the art has described larger water soluble bags containing multiple use amounts of a pelletized functional composition used in a dispenser where the water soluble bag is dissolved upon contact with a spray or stream of water from dispenser exposing the pellets to the water. (See U.S. Pat. No. 5,078,301).

Widespread use of water soluble packets containing detergent compounds has been hampered by physical and chemical compatibility of film with water and detersire systems. Many films such as polyvinyl-pyrrolidone, polyethyloxazoline and polyvinyl alcohol films can react with or interact with active components of a detersive system. Such films are known to be sensitive to moisture, which can soften the film and reduce tensile strength. However, more importantly, many of the chemicals commonly used in detergent compositions can attack the film and cause failure in the package integrity and/or water solubility especially when stored or used in humid conditions.

To this date, plastic bags containing uniform perforations have not been described using water soluble films. U.S. Pat. No. 4,743,123 describes a polyethylene plastic bag with laser-formed venting perforations.

SUMMARY OF THE INVENTION

It has been found that a water soluble film package can be protected from degradation by a detersire composition by using a water soluble film which has been perforated with uniform microscopic holes or perforations. The package when charged with the detersive composition enables entrapped air to be released from the package without leakage of any of the solid material when the solid is a cast solid, pelletized or particulate, i.e. granular or powder. Thus, when the package is sealed and then enveloped with an outerwrap bag, the package can be stored without fear of moisture being introduced into the package. Another advantage of the sealed water soluble package containing uniform microscopic perforations is that the package dissolves more quickly when the package is immersed into a wash solution or contacted with water through a misting, stream or spray.

Accordingly, the present invention in its first aspect resides in a sealed water soluble package comprising:

(a) a mono-layer, water soluble film container having uniform microscopic perforations, and (b) a use amount of cast solid, pelletized or particulate detersive composition contained within said container, wherein said composition is unable to pass through the perforations.

A second aspect of the present invention resides in a method for producing a perforated, stable, water soluble package comprising:

(a) perforating a mono-layer, water soluble film with uniform microscopic perforations, (b) forming a container with the perforated, water soluble film, (c) charging the container with a cast solid, pelletized or particulate detersive composition, and (d) sealing the container to enclose the detersive composition, wherein said composition is unable to pass through the perforations.

DETAILED DESCRIPTION OF THE INVENTION

Figure 1:
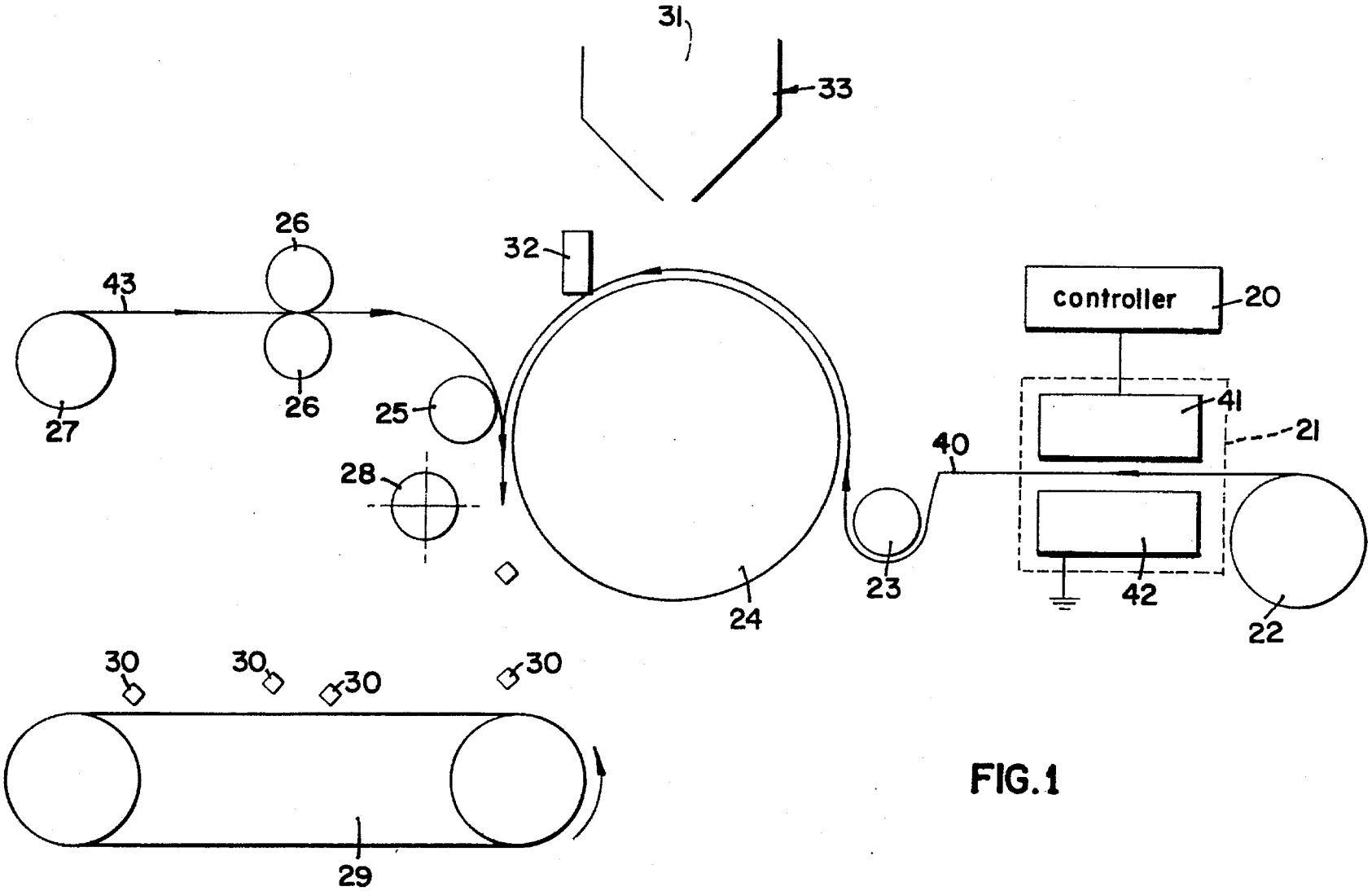
FIG. 1 is a schematic diagram illustrating a process for packaging a detersive composition within an arc perforated film.

The invention concerns a sealed water soluble package or bag which comprises a mono-layer, water soluble film container having uniform microscopic perforations. The bag is used to hold detersive compositions whose components can contain an acid, base or source of active halogen. Thus, these components normally chemically degrade water soluble film such as polyvinyl alcohol and other water soluble polymers. These bags can vary in size and can thus be used not only for household use, but also in industrial use. These bags have been found to dissolve and/or open more quickly because of the perforations when treated with water by means of a spray or mist in large industrial dispensing equipment or when merely dispensed into water in household warewashing operations.

The uniform microscopic perforations provide air to pass through the bag without leakage of any of the solid material regardless of whether the solid material is a cast solid, pelletized or particulate. By particulate, it is meant a normal powder or granular detergent composition used in the art.

The water soluble packages therefore not only address the problem of quick dissolution but also address the problem of chemical interaction with the film. This is done by modifying the film rather than isolating the composition from the film using coating or other means. In this manner, a normal water soluble, stable package is produced.

Film

The water soluble film used to make the packet may comprise any number of water soluble films formulated from water soluble or dispersible resins which are available commercially. Representative, non-limiting water soluble resins include polyvinyl alcohol, polyvinyl pyrrolidone, methylcellulose, hydroxyethylcellulose, hydroxypropyl cellulose, sodium carboxymethylhydroxyethylcellulose, polyvinyl acetate, polyethyloxazoline, and film forming derivatives of polyethylene glycol.

Preferred polymers are polyvinyl alcohol, polyvinyl acetate, polyvinyl pyrrolidone or mixtures thereof. More preferred are polyvinyl alcohol, polyvinyl acetate or mixtures thereof.

Most preferably, the film is a polyvinyl alcohol film which has adequate tensile strength and pliability under use conditions. The physical properties of PVA are controlled by molecular weight and the degree of hydrolysis. For most film applications, a molecular weight in the range of about 10,000 to about 100,000 is preferred. All commercial grades of PVA films can be dissolved in water, the only practical solvent for most cleaning purposes. The ease with which PVA can be dissolved is controlled primarily by the degree of hydrolysis which is the percent by which acetate groups of a polyvinyl acetate resin have been removed, leaving hydroxyl groups. Fully hydrolyzed products must be heated close to the atmospheric boiling point of water to completely dissolve. Lower temperatures are required as the degree of hydrolysis decreases until 75–80% hydrolysis is reached. The hydrolysis range of 86–89% is considered optimum for both cold and hot water solubility. Products with this optimum degree of hydrolysis are commonly referred to as partially hydrolyzed PVA. The hydrolysis of the acetate groups can continue in the presence of strong inorganic acids, bases and halogens which will interfere with the water solubility of the PVA film. This fact severely limits the choice of chemicals which may be included in the detergent formulation for water soluble packaging.

Preferably the polyvinyl alcohol used in the present invention has a molecular weight from about 10,000 to about 200,000, and more preferably from about 10,000 to about 100,000. The degree of hydrolysis present in the polyvinyl alcohol of the present invention is preferably from about 80 to 90% and most preferably from about 86 to about 89%.

Polyvinyl alcohol films used in making water soluble packages are generally manufactured in film thicknesses of about 1 to about 4 mils. Such films are readily suitable for use in the invention. Often, the films are etched or roughened to increase the surface area on one side of the film. This side of the film is then generally oriented to the outside of the film packet to allow greater surface area to be presented to the water to speed the dissolution of the PVA film. The inside of the package is generally smooth to reduce the likelihood of the film's degradation by compositions contained therein. In the preferred embodiment, the film thickness is from about 1.0 to about 2.5 mils, and the film is etched on the side which forms the outside of the container or bag.

The container or bag dimensions will be governed by the desired use of the detersive composition contained therein and the volume of detersive composition required to perform such a function. For ease and efficiency in manufacture, a roughly rectangular packet is preferred.

Useful water soluble films for use in the water soluble container include those that dissolve at a water temperature of about 1° C. to about 100° C., and more preferably from about 1° C. to about 85° C.

Perforations

The water soluble film may be perforated by an arc perforator, i.e., electrical discharge means. The water soluble film is passed through a system as described in U.S. Pat. No. 3,471,597 which describes the perforation by electrical discharge of polyolefin films such as polyethylene. This patent is incorporated herein by reference.

Using the design described in U.S. Pat. No. 3,471,597 with some modifications that allow the adjustment of electrode timing and measurement of the voltage output, water soluble film such as polyvinyl alcohol can be successfully perforated. The perforations may vary in size and distance from each other, as desired, for example depending on the package size to be used and chemical content. Operative and preferred parameters for the perforated film include:

| | Useful | Preferred | Ideal |
|---|---|---|---|
| Diameter of Perforation or Hole | 0.0005–0.125 in. | 0.001–0.004 in. | 0.0005–0.0015 in. |
| Distance Between Columns | machine dependent | 0.5–12.0 in. | 0.5–4.0 in. |
| Distance Between Holes | 0.05–1.0 in. | 0.1–0.3 in. | 0.05–0.15 in. |
| Film Thickness | 0.5–5.0 mil. | 1.0–2.0 mil. | 0.5–2.5 mil. |

The ability to electrically perforate dielectric films is dependent on the dielectric strength of the film. When the film is perforated, or a hole in the film is created, this is caused by electrical energy channeling through a fault in the film. Polymer films that appear to be most amenable to electrical perforation have one or more of the following properties:

1) polarity;

2) containing contaminations or additives such as cellulosic fibers, colorants and particulates (in the additive that would cause a stress concentration or discontinuity on the film surface), and/or 3) air bubbles or water dispersions that would contribute to the breakdown on the film allowing electrical energy to penetrate through the surface. Once the material has failed (penetration through the surface is completed), the electrical discharge heat energy "reams" a hole in the film.

It was found that water soluble film such as polyvinyl alcohol film exhibits different surface characteristics than the typical polyethylene film. Polyvinyl alcohol film is processed using extrusion technology, for example, solution cast, extrusion cast and blown extrusion. If the film is viewed under a light microscope, one can see trapped air bubbles in the film. The discontinuity of the polyvinyl alcohol film allows it to be successfully perforated utilizing an arc perforator which employs a dual capacitor charging circuit and an inductive coil to generate a spark. The firing signal can be controlled using a timer relay which can be adjusted according to the particular product that is being perforated. The timer relay triggers a pulse across a transistor, when the transistor is gated, this is forcing the capacitors to discharge through a coil, the rush of current and voltage at that time to create a spark.

Figure 2:
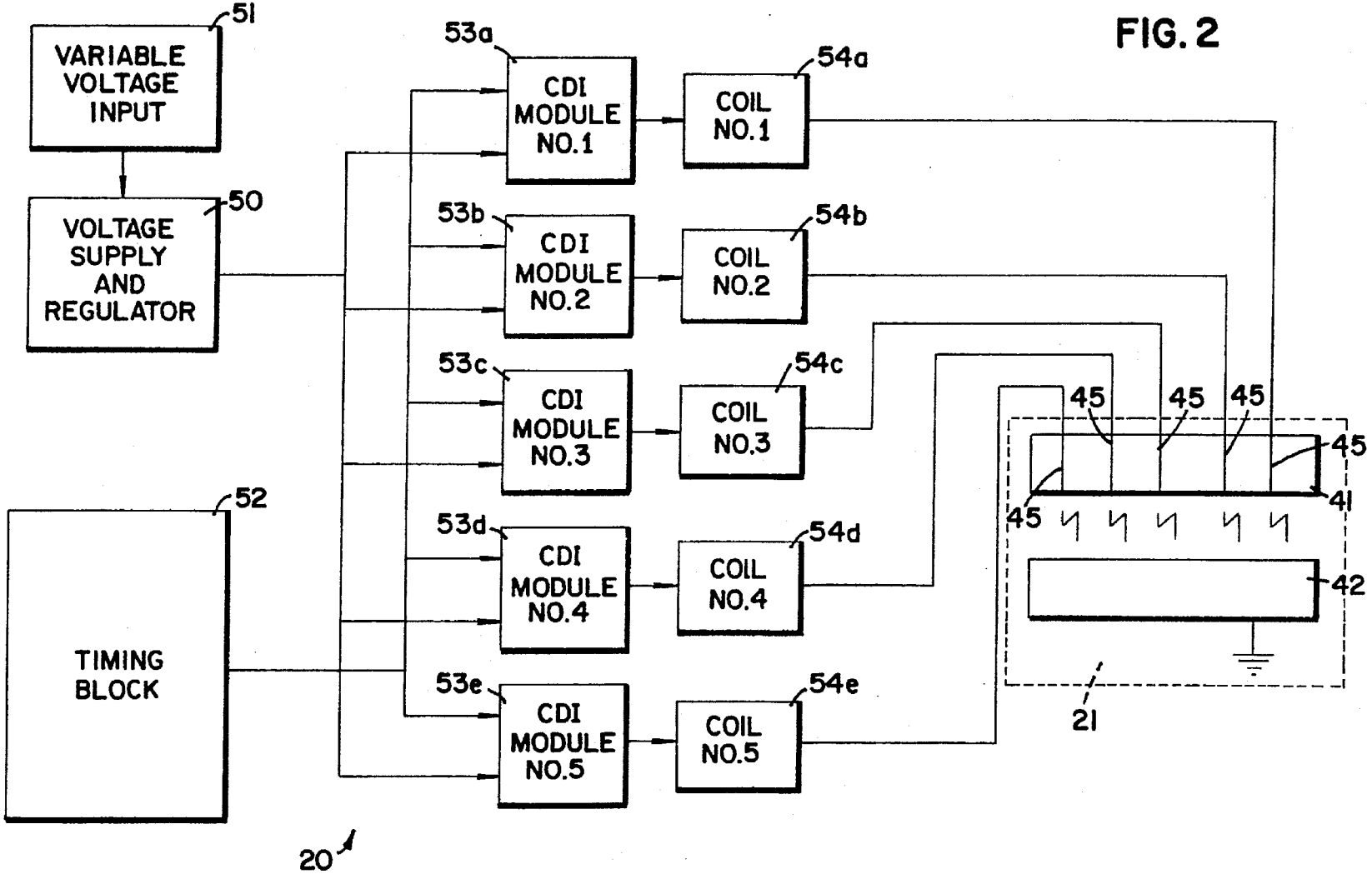
FIG. 2 is a detailed view of the controller 20.
Figure 3:
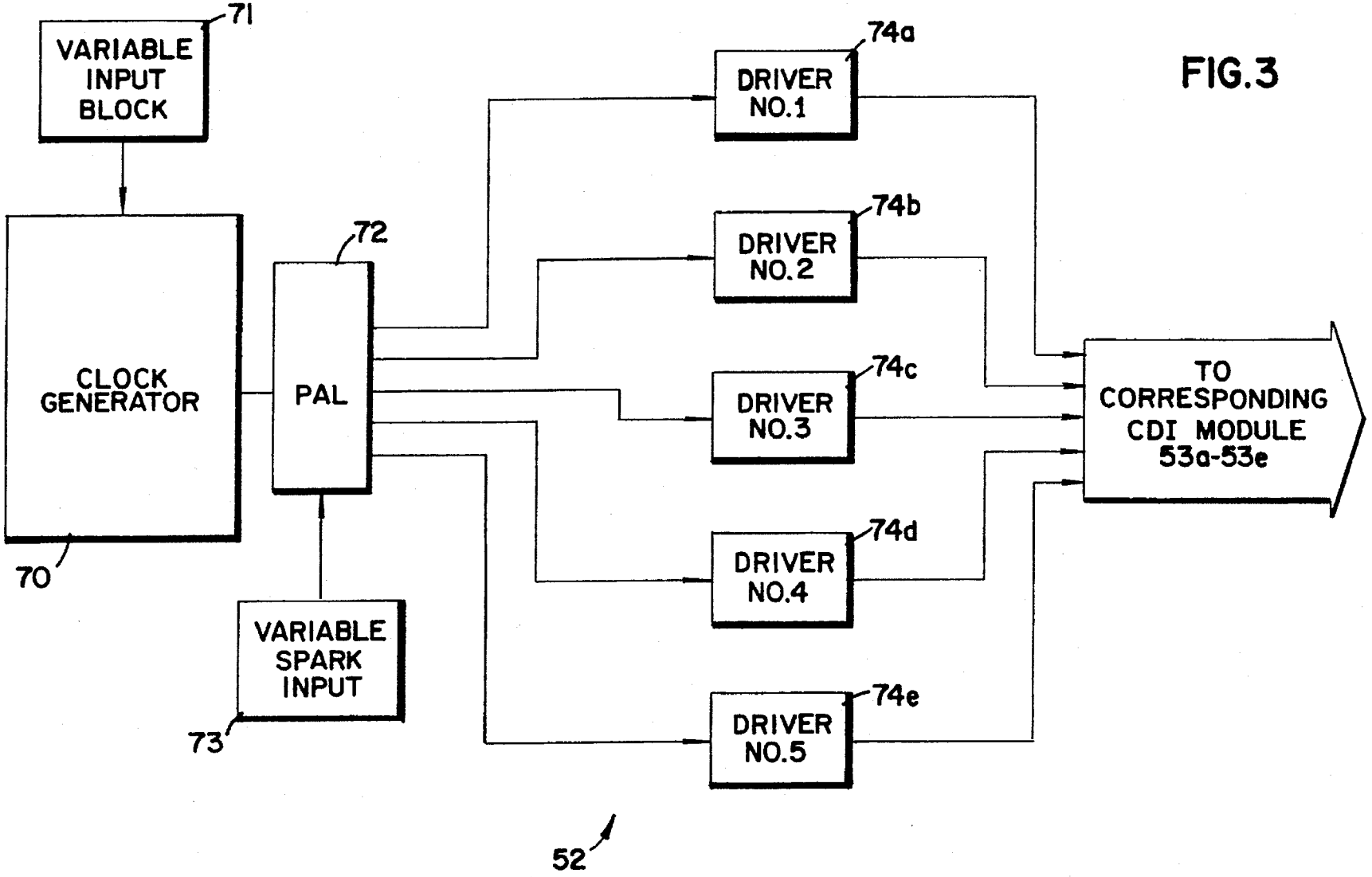
FIG. 3 is a detailed view of the timing block 52.

One preferred embodiment of an arc perforator constructed in accordance with the principles of the present invention is illustrated in FIGS. 1, 2, and 3. The arc perforator is shown generally at 21, while the electronic controller for the arc perforator is shown generally at block 20. It will be appreciated that the controller 20 functions to control the frequency and strength of the arc discharge of the arc perforator 21. In order to better describe the operation of the arc perforator 21, a discussion of the controller 20 will be deferred pending a brief description of a preferred apparatus for packaging the detersive compositions 31 within the arc perforated film.

Referring to FIG. 1, a first supply 22 of film material 40 is provided in web form about a rotatable axis. The film material 40 from the first supply 22 first moves between the positive 41 and negative 42 portions of the arc perforator device 21 where the film material is perforated. Upon exiting the device 21, the now perforated film material 40 is carried about heated roller 23. In the preferred embodiment, heated roller 23 is heated to approximately 325° F. which, therefore, heats the film material 40. Those skilled in the art will appreciate that the temperature of such roller is dependent upon several factors including the composition of the film material 40.

The heated film material 40 is then fed upon and carried about can-shaped vacuum roller 24. Roller 24 includes a plurality of recessed open cavities (not shown) relative to its curved mean surface and a vacuum manifold (not shown) in fluid communication with the lower portion of each of the cavities. The application of the vacuum with the heated film material 40 covering the curved mean surface tends to draw the heated film material 40 into the cavities, thereby forming film material pockets. It will be appreciated by those skilled in the art that the shape of the cavities may vary depending on the desired or necessary shape of the resulting packets of material 30. In the preferred embodiment, the cavity is generally a rectangular parallelepiped with radiused edges.

The roller 24 carries the film material 40 (in the direction shown in the arrows in FIG. 1) to a predetermined position where the detersive composition 31 to be packaged is released from container 33 into the film material pockets. Wiper arm 32 operates to insure that the film material pockets are filled and that excess detersive composition 31 is precluded and/or operatively minimized from moving past the predetermined packing position. Preferably the predetermined packing position is performed when the pockets to be packed are in an upright position.

Still referring to FIG. 1, a second supply 27 of film material 43 is provided in web form which is rotatably mounted on an axis. The second film material 43 moves through opposing water rollers 26 which apply water to the second film material 43 and then about heated roller 25. The heated, watered second film material 43 is then applied to the mean curved surface of roller 24 and on top of first film material 40. Preferably the application of the second film material occurs at a location about roller 24 prior to any of the detersive composition 31 being released or falling from the pockets due to the operation of gravity, etc. Therefore, the action of applying the second film material 43 over the first film material 40 acts to completely encompass the detersive composition 31 within the film material pockets (e.g., between the first material 40 and the second material 43). The heating and watering of the second film material 43 operates to bond the two film materials 40 and 43 to one another. While the second heated roller 25 is heated to approximately 225° F., such temperature is dependent upon the types of film being used among other factors.

A heated cutting roller 28 is used to cut through the first 40 and second 43 films at locations about the periphery's of the now sealed pockets which contains the detersive composition 31. The cutting roller 28 is heated to 500° F. Packets 30 containing the detersive composition 31 then drop onto a conveyor 29 by gravity to be containerized, etc. It will be appreciated that the vacuum source may also be discontinued (or reversed) to help expel the packets 30 from the cavities.

Turning next to FIG. 2, the controller 20 is shown in more detail. First, a regulated voltage supply block 50 is provided. The voltage supply and regulator block 50 is connected to a variable voltage input block 51. While not shown, the regulated voltage provides power to the various components of the controller 20. It also provides energy to the coils **54*a*–54*e* (via the CDI modules 53*a*–53*e*) which provide the arc discharges between the first (ungrounded) 41 and second (grounded) 42 portions of the arc perforator device 21. Timing block 52 provides the triggering signal input to the five CDI modules designated as blocks 53*a*–53*e***.

Preferably, the capacitor discharge ignition (CDI) modules **53*a*–53*e* each comprise a standard car ignition device of the type manufactured by Universal Corporation of Grand Junction, Colo. under the designation Tiger CDI. The functionality of each of the CDI modules 53*a*–53*e* is to act as an amplifier of the timing signal from timing block 52. This is accomplished by storing energy in a capacitor in each of the CDI modules 53*a*–53*e* and dumping the stored energy (upon receipt of the timing signal) in a pulse into the primary coil of the respective coil block 54*a*–54*e*. The functional coil blocks 54*a*–54*e* are preferably a 12 volt ignition coil of the type used in automobiles and which are compatible with the CDI module utilized. Upon application of the voltage pulses from the CDI module 53*a*–53*e*, the coil blocks 54*a*–54*e* provide stepped up high voltages from secondary coils, thereby causing an arc discharge across the gap in the arc perforator device 21** to ground.

Turning now to FIG. 3, the timing block 52 is illustrated in more detail. Clock generator block 70 provides a timed input signal to the programmable block (PAL) 72. Adjustments to the clock signal may be made by variable input block 71. In the preferred embodiment, the clock generator block 70 includes a clock generator chip designated LM555.

Programmable block 72 includes programming to sequentially trigger drivers **74*a*–74*e* and preferably includes a variable spark input block 73. In the preferred embodiment, the programmable block 72 is an integrated circuit of the type designated 5AC312 manufactured by Altera Corporation of San Jose, Calif. The variable spark input block 73 provides for adjustment of the timing of the number of triggering pulses delivered to each CDI module 53*a*–53*e*. The variable input is an encoded switch connected to pins SW0, SW1 and SW2 of programmable block 72. In the preferred embodiment, a series of pulses ("bursts") are delivered to each CDI module 53*a*–53*e* and then a period of no pulses occurs. During the burst, the arcs preferably occur through the same perforation in the film material 40. It is believed that a series of arcs provides for more uniformly sized perforations. In the preferred embodiment, one to eight arcs are created through each perforation, and then a time out period occurs for the film material 40 to advance sufficiently to the next area in which a perforation is desired. The exact number of arcs which generates perforations of a uniform nature is believed to be dependent, in part, on the type of film material 40** utilized. In the preferred embodiment, 2–3 arcs per perforation is utilized.

The sequential trigger signals generated by the programmable block 72 are provided to drivers **74*a*–74*e* respectively. Driver blocks 74*a*–74*e* are utilized to provide a current gain in the output signal of the programmable block 72 and to isolate the timing device blocks 70 and 72 from the CDI modules 53*a*–53*e*. In the preferred embodiment, the driver blocks are integrated circuits identified by the number DS3658 and each of the driver chips have all of their inputs tied together and all of their outputs tied together. In the preferred embodiment, a resetting current limiting device (not shown) is placed in series between each driver block 74a–74e and each CDI module 53a–53e**, respectively.

In operation, the CDI modules 53a–53e and the coils 54a–54e operate to discharge a high voltage to ground across the arc gap and through the film material 40 of arc perforator device 21. The trigger signal is generated by the timing block 52 to the CDI modules 53a–53e. The timing of the trigger signals generated by the timing block 52 (and therefore the arcs) occur sequentially in the preferred embodiment in order to avoid high transient loads on the voltage supply and regulator block 50. However, it will be appreciated by those skilled in the art that such voltage supply may be sized in a manner to handle higher loads to eliminate the requirement for sequential triggering.

In the preferred embodiment, the electrodes 45 in arc perforator 21 include a portion running in the direction of movement of the film material 40 (e.g., into the page in FIG. 2) to provide a larger electrode surface area. It is believed that this aids in the burst of arcs moving through the same perforation. It is also believed that the ionized air path from the first arc aids in subsequent arcs moving through the same perforation.

It will be appreciated by those skilled in the art that the intensity of the arc and the frequency of the arc may be adjusted by the various blocks described above, and that the frequency of the arc may also be adjusted to compensate for the speed of the film material 40 through the arc perforator device 21. Still further, it will be appreciated that an additional arc perforator device might be included to arc perforate the second film material 43, if desired or necessary.

Water Soluble Container

The perforated, water soluble container or bag may be made by sealing the edges of the perforated water soluble film by any means known to those in the field of the art. Such means include the use of adhesives, ultrasonic sealing, heat sealing, pressure sealing and water sealing. Preferably the finished packets are water sealed.

Detersire Composition

Generally detersive compositions contain at least one cleaning agent such as soap detergent, alkaline salt or combination thereof. In the context of detersire compositions, especially those designed for washing surfaces and fabrics such as dishware and laundry items, a detersire composition is described as the blend of chemical agents that can remove soil by employing one or more of the following mechanisms generally in conjunction with mechanical action:

1. lowering the surface and interfacial tension of the cleaning solution made from the detersire system promoting soil removal,
2. solubilization of soils,
3. emulsification of soils,
4. suspension/dispersion of fatty soils,
5. saponification of fatty soils and enzyme digestion of proteinaceous soils,
6. inactivation of water hardness, and
7. neutralization of acid soils.

Detersive compositions are concentrates that comprise a combination of ingredients that can be used primarily in dilute form in aqueous media and can act to remove soil from a substrate. The detersive systems of this invention are typically in the form of a particulate, a pellet or a larger solid mass. Particulates include products made by particle mixing, dry blending and granulation. Solids include cast solids, extrudates or compressed solids.

A detersive composition typically contains a detergent which is a chemical compound that can weaken or break bonds between soil and a substrate. Organic and inorganic detergents include surfactants, solvents, alkalis, basic salts and other compounds. A detersive composition is typically used in a liquid cleaning stream, spray, bath, etc. which produces an enhanced cleaning effect that is caused primarily by the presence in the bath of a special solute (the detergent) that acts by altering the interfacial effects at the various phase boundaries (i.e. between soil, substrate and both) within the system. The action of the bath typically involves more than simply soil dissolution. The cleaning of washing process in a typical detersive composition usually consists of the following sequence of operations. The soiled substrate is immersed or otherwise introduced into or contacted by a large excess of a bath containing a detergent solute. The soil and the underlying object or substrate typically becomes thoroughly wetted by the bath. The system is subjected to mechanical agitation by rubbing, shaking, spraying, mixing, pumping or other action to provide a shearing action which aids in the separation of the soil from the substrate. The bath now containing the soil is typically removed from the object to be cleaned, the object is rinsed and often dried.

Detersire compositions are often used in cleaning hard surfaces such as sinks, tiles, windows, and other glass, ceramic, plastic or other hard surface dishware, and laundry or other textiles. Soils removed from substrates by the detersire compositions are extremely variable in composition. They may be liquid, solid or a mixture thereof. The soils typically consist of mixtures of proteinaceous, carbohydrate, and fatty materials typically in combination with inorganic components and some water.

Detersive baths typically contain a detergent which is often an organic surfactant detersire component, or combinations of organic and inorganic components, and can typically be used in combination with other organic and inorganic components that provide additional properties or enhance the basic detersive property of the detersire component. The compositions dissolved or suspended in water to provide detersire systems are formulated to suit the requirements of the soiled substrate to be cleaned and the expected range of washing conditions. Few cleaning systems have a single component. Formulated detersire compositions consisting of several components often outperform single component systems. Materials which can be used independently in detersire systems are as follows:

(a) surfactants including various synthetic surfactants and natural soaps;

(b) inorganic builders, diluents, or fillers including salts, acids and bases;

(c) organic builder additives which enhance detergency, foaming power, emulsifying power, soil suspension and sequestering agents which reduce the effects of hardness in service water;

(d) special purpose additives such as bleaching agents, brightening agents, enzymes, bactericides, anticorrosion agents, emollients, dyes, fragrances, etc.; and (e) hydrotrope solubilizers used to ensure a compatible uniform mixture of components including alcoholic cosolvents, low molecular weight anionic surfactants, emulsifying agents, etc.

Organic Surfactant

Preferred surfactants are the nonionic, anionic, and cationic surfactants. Cationic surfactants such as quaternary ammonium compounds are frequently used in detersive systems but are typically not cleansing ingredients and are used for purposes such as sanitizing or fabric softening.

Soil removing surfactants can comprise soaps, i.e. (a) sodium or potassium salts of fatty acids, rosin acids, and tall oil; (b) alkylarene sulfonates such as propylene tetramer-benzene sulfonate; (c) alkyl sulfates or sulfonates including both branched and straight chain hydrophobes as well as primary and secondary sulfate groups; (d) sulfates and sulfonates containing an intermediate linkage between the hydrophobic and hydrophilic groups such as taurides and sulfonated fatty monoglycerides, long chain acid esters of polyethylene glycol, particularly a tall oil ester; (f) polyalkylene glycol ethers of alkyl phenols wherein the alkylene group is derived from ethylene or propylene oxide or mixtures thereof; (g) polyalkylene glycol ethers of long chain alcohols or mercaptans, fatty acyl diethanolamides; (h) block copolymers of ethylene oxide and propylene oxide; and others.

Preferred examples of nonionic surfactants include the following: $C_{6-12}$ alkyl phenol ethoxylates and/or propylates, $C_{5-20}$ alcohol ethoxylates or propoxylates, EO/PO block copolymers (pluronic and reverse pluronics), or mixtures thereof.

Inorganic Compounds

Detersive systems can contain inorganic detergent compounds which are typically grouped into the following six categories: alkalis, phosphates, silicates, neutral soluble salts, acids, and insoluble inorganic builders.

Sources of alkalinity useful in the invention include but are not limited to the following: alkali metal hydroxides, alkali metal carbonates, alkali metal bicarbonates, alkali metal sesquicarbonate, alkali metal borates, and alkali metal silicate. The carbonate and borate forms are typically used in place of alkali metal hydroxide when a lower pH is desired. Silicates ($na_2O:SiO_2$ compounds) which are typically a reaction product between sodium hydroxide and silica, have a variety of $na_2O:SiO_2$ reaction molar ratios. Silicates are primarily used as alkalis and as builders in both warewashing and laundry formulations.

Threshold agents can include organic and inorganic carboxylates, phosphates, phosphonates and mixtures thereof. Such agents include but are not limited to the following: organic acrylate polymers, phosphinic and phosphonic acids, inorganic phosphate compositions including monomeric phosphate compounds such as sodium orthophosphate and the higher condensed phosphates including tetraalkali metal pyrophosphates, sodium tripolyphosphate, glassy phosphates and others. Threshold agents are typically used at low concentration, about 0 to 500 ppm, in order to slow or delay the formation of deposits of hardness components through a much less than stoichiometric reaction between the threshold agent and the inorganic components of hardness in service water. Phosphates are typically used as sequestering, suspending and cleaning agents. Sodium tripolyphosphate is the most widely used builder in heavy duty detergents.

Neutral soluble salts which are typically the reaction product of a strong acid a strong base including sodium sulfate, sodium chloride, and others can also be used in conjunction with or in combination with the detersive compositions of the invention. Neutral soluble salts are typically used as builders or diluents in synthetic surfactant based detersive compositions.

Insoluble inorganic builders are often used solid, pelletized and particulate detersive compositions. The insoluble inorganics including clays, both natural and synthetic, such as montmorilonite clay or bentonite clay, can have a detersive effect in certain systems.

Organic Builders and Additives

Further, the detersive systems can contain organic builders and other special purpose additives. This class of compound comprises organic molecules have little detersive nature but containing many other desirable properties including antiredeposition additives, sequestrants, antifoaming or foaming additives, whiteners and brighteners, additives or hydrotropes for maintaining the solubility of components, and additives for protecting both the substrate and the washing apparatus. The most common organic additives include organic sequestrants and organic antiredeposition agents. Organic sequestrants include compositions such as polyacrylic acid and methacrylic acid polymers, ethylene diamine tetraacetic acid, nitrilotriacetic acid, etc. and others.

Sources of Active Halogen or Chlorine

Sources of active chlorine used in the detersire compositions include but are not limited to the following: alkali metal and alkaline earth metal hypochlorite, chlorinated condensed phosphates, dichloroisocyanurate, chlorinated cyanurate, and mixtures thereof. Specific examples of active chlorine sources include the following: calcium hypochlorite, chlorinated sodium tripolyphosphate, and sodium dichloroisocyanurate dihydrate.

Sources of Acid Components

Sources of acid components used in detersire compositions include but are not limited to the following: citric, succinic, sulfamic, tartaric, adipic, fumeric, oxalic, maleic and malic acids, as well as alkali metal acid phosphates, e.g. sodium or potassium acid phosphate, and mixtures thereof.

Common detersive compositions in use today are laundry detergents, industrial institutional and household dishwashing or warewashing compositions, clean-in-place and hard surface cleaning compositions.

In aqueous dishwashing, detersive solutions are prepared from typically liquid, particulate, pelletized or solid detersire systems by the action of water within a warewashing machine. The softening agent of this system can be used in detersire compositions prepared from solid, pelletized or particulate warewashing cleaners.

Dishwashing detersive systems typically comprise a source of alkali in the form of an alkali metal hydroxide, alkali metal carbonate, or alkali metal silicate in combination with a hardness sequestering agent, optional surfactants, a source of active halogen, and other optional chemical substances.

Laundry detersive compositions typically in the form of particulate or solid compositions can be used in both household and institutional laundry equipment to clean and destain typically soiled fabric articles. Cleaning of such articles is typically accomplished by removing soil that is physically associated with the fabric and by desraining or bleaching soils that cannot be removed by typical detersire systems. Laundry compositions typically comprise anionic or nonionic surfactants, water, softening or hardness sequestering agents, foam stabilizers, pH buffers, soil suspending agents, perfumes, brighteners, opacifiers, and colorants.

The most common degrading components are strong alkaline materials, strong acids, an active chlorine source or mixtures thereof.

The detersive composition can be used in hard surface cleaning, hand cleaning, general household cleaning, car washing, recreational equipment cleaning, etc. Such detersire compositions are used in the form as shown below.

TABLE A

Hard Surface Cleaner Composition

| Component | Useful Wt- % | Preferred Wt- % | Most Preferred Wt- % |
|---|---|---|---|
| Surfactant | 0.1–95 | 0.5–20 | 0.5–10 |
| Sequestering agent | 0.1–40 | 1–30 | 10–30 |
| pH Control agent | 2–99.8 | 5–96 | 10–96 |

TABLE B

C-I-P Composition

| Component | Useful Wt- % | Preferred Wt- % | Most Preferred Wt- % |
|---|---|---|---|
| Source of alkalinity | 5–70 | 10–60 | 20–50 |
| Chlorine source | 0.1–50 | 1–30 | 5–20 |
| Sequestering agent | 1–60 | 2–50 | 3–40 |

TABLE C

Laundry Granular Composition

| Component | Useful Wt- % | Preferred Wt- % | Most Preferred Wt- % |
|---|---|---|---|
| Surfactant | 0.5–50 | 1–40 | 1–25 |
| Source of alkalinity | 0.1–95 | 1–40 | 10–40 |
| Sequestering agent | 1–60 | 2–50 | 2–40 |

TABLE D

General Detersive Composition

| Component | Useful Wt- % | Preferred Wt- % | Most Preferred Wt- % |
|---|---|---|---|
| Source of alkalinity | 0.1–60 | 0.5–50 | 1–40 |
| Surfactant | 0.5–10 | 1–5 | 1–4 |
| Chlorine source | 0–10 | 1–5 | 1–4 |
| Sequestering agent | 1–60 | 2–50 | 3–40 |

Perforated, water soluble film containers are charged with a pre-determined amount of the solid, pelletized or particulate detersive composition above described, and the containers are sealed.

Moisture Impervious Outerwrap

In order to protect the sealed, water soluble, detersire package of the present invention during storage, shipping and handling, a water impervious outerwrap can be provided to prevent damage from atmospheric moisture such as high humidity, rain and dew and from accidental contact with water by splashing or wet hands. Although the water impervious outerwrap can be provided for groups of packages, preferably the water impervious outerwrap is provided individually for each package for reasons of customer safety and convenience and product protection. Once the water impervious outerwrap is removed, the package is either promptly inserted into a dispenser or into the warewashing or cleaning apparatus.

The terms "water impervious outerwrap" and "moisture impervious outerwrap" are used interchangeably herein.

Suitable materials for the water impervious outerwrap include, but are not limited to, the following: Polyolefin films such as polyethylene or polypropylene, Kraft paper which can be moisture-proofed with polyethylene, moisture-proofed cellophane, glassine, metal foils, metallized polymer films, polyester, polyvinyl chloride, polyvinylidene chloride or waxed paper combinations of these materials as in laminate. The selection of material for the water impervious outerwrap is determined by a number of factors including the cost of the material and the strength required. Preferably, the water impervious outerwrap comprises a polyethylene film for reasons of cost of material and moisture barrier properties. The preferred film for the outerwrap is a polyethylene film commercially available from several manufacturers. The specifications are provided in U.S. Pat. No. 5,078,301 which patent is incorporated herein by reference.

The disposal of the moisture impervious outerwrap presents no health or pollution hazard as does the disposal of the normal package for potentially harmful material. Since the moisture impervious outerwrap has not contacted the contents of the water soluble bag, no residual amounts of the potentially harmful contents remain in it. The water soluble package itself, of course, completely dissolves and, therefore, creates no disposal problems.

Bags to serve as the moisture impervious outerwrap are made by the same method as for the water soluble film packages by heat sealing three edges except that the films are typically cut to be about 1 to 3 inches wider and about 1 to 4 inches longer than the water soluble package which it contains.

A margin of the moisture impervious outerwrap, preferably the side margin, can contain a slit which extends part way through the margin to aid the user in opening the moisture impervious outerwrap.

A polyethylene water impervious outerwrap having the following dimensions can be used to enclose a water soluble bag containing 4 lbs. of pelletized functional composition.

| Dimensions: Inside dimension (not including seal area) | |
|---|---|
| Width (opening) | 8 ¾" |

-continued

| Dimensions: Inside dimension (not including seal area) | |
|---|---|
| Length | 12 ¾" |
| Thickness | 0.0027" min. |
| Dimensional tolerance | +/– ¼' |
| Style: Flat bag style | |
| Seals: 3-side-seal with 10 mm seals. | |

The fourth side is sealed by means of heat in order to provide at least about a 10 mm margin.

The water impervious outerwrap can comprise a variety of forms including but not limited to the following: a box, a carton, an envelope, a bag, a tub, a pail, a can and a jar. Preferably the water impervious outerwrap comprises a flexible bag for reasons of ease of handling and storage.

The outside of the moisture impervious outerwrap can have printed thereupon directions for use and appropriate warnings.

Method of Use

The detersive composition in solid, pellet or particulate form is typically used by placing the water soluble package after removal of the water impervious outerwrap directly in a warewashing or cleaning apparatus for a single use cycle, especially in households. For industrial cleaning and warewashing use, the package is best placed in a dispenser which allows for water being sprayed through a hose in the dispenser dissolving the bag and allowing the detersive composition to be released into the appropriate apparatus such as described in U.S. Pat. No. 5,078,301.

The following examples are provided as illustrative of the present invention.

EXAMPLES

The water soluble films used in the present invention are available from a number of commercial sources including the MONO-SOL® Division of Chris Craft Industries, Inc. A particularly useful type of water soluble polyvinyl alcohol film is the 7-000 series of polyvinyl alcohol films which is available form the MONO-SOL® Division of Chris Craft Industries, Inc. The 7-000 series of polyvinyl alcohol films dissolve at a water temperature of about 34° F.–200° F. Such films are nontoxic and display a high degree of chemical resistance. A 0.002 inch +/– 0.0002 inch thick 7-000 series polyvinyl alcohol film has the following properties and performance characteristics:

TABLE A

| Properties | Value |
|---|---|
| Clarity | Translucent |
| Yield (in./lb.) | 11,600 in./lb. |
| Hot bar heat seal range | 310–350° F., 30 psi ¾ second dwell |
| Impulse heat seal range | 0.8–1.0 second, 80 psi 1 second cooling |
| Water temperature range for solubility | 34° F.–200° F. |

| Performance | Value | Test Method |
|---|---|---|
| Tensile strength (at break) | 6000 lb./sq. in. min. | ASTM D 822 |
| Tear strength | 1000 gm/mil min. | ASTM D 1922 |
| Burst strength (Mullen) | Exceeds limit of equipment | TAPPI |
| Elongation | 450% min. | ASTM D 822 |

When selecting a water soluble film for use in the water soluble bag, one must take into account the water temperature at which one desires the water soluble bag to dissolve. It is often desirable to choose a water soluble film that can dissolve at a low water temperature so that the invention functions properly over a wide range of water temperatures. It is not uncommon for the water used during a first wash cycle, for example, to have a lower temperature than water used in subsequent cycles.

Useful water soluble films for use in the water soluble bag include those that dissolve at a water temperature of about 34° F. It is preferable, however, that the water soluble film for use in the water soluble bag dissolve at a water temperature range of about 50° F.–200° F., for reasons of faster dissolution rate of the water soluble bag and therefore faster dispensing of the product.

It is also important to select a water soluble film that does not react with the pellets contained in the water soluble bag formed therefrom. Other factors which should be considered when choosing a water soluble film to form the water soluble bag include the following: the effect of the water soluble film on equipment including pumps, pipes and nozzles; the effect of the water soluble film on waste water; the toxicity of the water soluble film; the printability of the water soluble film; and properties which allow the water soluble film to be used on automated bag-making equipment (i.e. sealability, tensile strength and tear strength).

Printability is a factor since one may desire to print appropriate warnings and instructions on the water soluble bag.

Materials useful as the water soluble bag should have the following minimum properties in order to be successfully utilized.

The material should have a maximum hot bar heat seal range of about 350° F., 30 psi, ¾ second dwell.

The material should have a maximum impulse seal range of about 1 second, 80 psi, 1 second cooling.

The material should have a minimum water temperature range for solubility of about 34° F. minimum.

The material should have a minimum tensile strength (at break) of about 6000 lb./sq. in. according to the ASTM D822 test method.

The material should have a minimum tear strength of about 1000 gm/mil according to the ASTM D 1922 test method.

The material should have a minimum elongation of about 450% according to the ASTM D822 test method.

Arc perforated packets of an acid cleaner, an alkaline cleaner, an all-purpose cleaner and a disinfectant detergent composition, Formulations A–D respectfully, were made with the Solid State 1-Up Arc Perforator Prototype. The perforator was set to arc as rapidly as possible (termed continuous because no delays were imposed).

Samples of unformed film were taken to measure the diameter and frequency of perforations. A statistical analysis is attached. The date indicates product and film thickness (MONO-SOL® 7030 1.5 and 2.0 mil.) did not effect perforation diameter. Film thickness did effect perforation frequency. The 2 mil. film averaged about twice the distance between perforations with the 1.5 mil. film.

During the run, on line deflation was excellent for all products.

Packets were evaluated for opening time and leakage of powder in vibration testing.

ARC PERFORATION
UNFORMED FILM SAMPLES
FOR PACKET DISTRIBUTION TEST REFERENCE

| DIAMETER (INCHES) | | | DISTANCE |
|---|---|---|---|
| X | Y | AVG (X,Y) | INCHES |
| | | Formulation A | |
| 0.0029 | 0.0028 | 0.00285 | 0.1318 |
| 0.0023 | 0.0024 | 0.00235 | 0.1331 |
| 0.003 | 0.0026 | 0.0028 | 0.1392 |
| 0.0039 | 0.0031 | 0.0035 | 0.1089 |
| 0.0026 | 0.0025 | 0.00255 | 0.0804 |
| 0.0021 | 0.0019 | 0.002 | 0.1052 |
| 0.0035 | 0.0031 | 0.0033 | 0.1208 |
| 0.0023 | 0.0017 | 0.002 | 0.2687 |
| 0.0026 | 0.0021 | 0.00235 | 0.1057 |
| 0.0054 | 0.003 | 0.0042 | 0.0509 |
| 0.0023 | 0.0027 | 0.0025 | 0.0899 |
| 0.0035 | 0.0028 | 0.00315 | 0.0766 |
| 0.0023 | 0.002 | 0.00215 | 0.1216 |
| 0.0026 | 0.0024 | 0.0025 | 0.114 |
| 0.0031 | 0.0031 | 0.0031 | 0.1428 |
| 0.0037 | 0.0034 | 0.00355 | 0.1071 |
| 0.0027 | 0.0027 | 0.0027 | 0.2136 |
| 0.002 | 0.0021 | 0.00205 | 0.1112 |
| 0.0024 | 0.0029 | 0.00265 | 0.1427 |
| 0.0029 | 0.0026 | 0.00275 | 0.1065 |
| 0.0024 | 0.0022 | 0.0023 | 0.0928 |
| 0.0024 | 0.002 | 0.0022 | 0.1193 |
| 0.0024 | 0.0025 | 0.00245 | 0.1394 |
| 0.0027 | 0.0023 | 0.0025 | 0.0998 |
| 0.0022 | 0.002 | 0.0021 | 0.3109 |
| 0.0024 | 0.0024 | 0.0024 | 0.0834 |
| 0.0024 | 0.002 | 0.0022 | 0.0998 |
| 0.0021 | 0.0022 | 0.00215 | 0.0946 |
| 0.0028 | 0.0024 | 0.0026 | 0.1201 |
| 0.0024 | 0.0022 | 0.0023 | 0.1151 |
| 0.0027 | 0.0025 | 0.0026 | 0.1249 |
| 0.0007 | 0.0004 | 0.0005 | 0.0524 |
| | | Formulation B | |
| 0.0034 | 0.0026 | 0.003 | 0.2755 |
| 0.0013 | 0.0017 | 0.0015 | 0.1172 |
| 0.0018 | 0.0017 | 0.00175 | 0.1002 |
| 0.0023 | 0.0022 | 0.00225 | 0.0887 |
| 0.0028 | 0.0023 | 0.00255 | 0.1456 |
| 0.00181 | 0.0017 | 0.001755 | 0.3755 |
| 0.0016 | 0.002 | 0.0018 | 0.0969 |
| 0.0024 | 0.0022 | 0.0023 | 0.133 |
| 0.0025 | 0.0024 | 0.00245 | 0.11178 |
| 0.0071 | 0.0051 | 0.0061 | 0.7217 |
| 0.0028 | 0.002 | 0.0024 | 0.1812 |
| 0.0024 | 0.0018 | 0.0021 | 0.2027 |
| 0.0014 | 0.0015 | 0.00145 | 0.1231 |
| 0.0053 | 0.0054 | 0.00535 | 0.5253 |
| 0.0013 | 0.0013 | 0.0013 | 0.1347 |
| 0.002 | 0.0019 | 0.00195 | 0.2087 |
| 0.0026 | 0.0023 | 0.00245 | 0.4153 |
| 0.0048 | 0.0039 | 0.00435 | 0.5299 |
| 0.0051 | 0.0042 | 0.00465 | 0.5669 |
| 0.0024 | 0.0022 | 0.0023 | 0.4228 |
| 0.0019 | 0.0024 | 0.00215 | 0.1608 |
| 0.0024 | 0.0021 | 0.00225 | 0.3174 |
| 0.0036 | 0.0023 | 0.00295 | 0.0954 |
| 0.0018 | 0.0017 | 0.00175 | 0.5555 |
| 0.0033 | 0.003 | 0.00315 | 0.2109 |
| 0.0015 | 0.0022 | 0.00185 | 0.2347 |
| 0.0021 | 0.0014 | 0.00175 | 0.1646 |
| 0.0023 | 0.0017 | 0.002 | 0.2901 |
| 0.0043 | 0.0044 | 0.00435 | 0.5935 |
| 0.0027 | 0.0032 | 0.00295 | 0.5385 |

-continued

ARC PERFORATION
UNFORMED FILM SAMPLES
FOR PACKET DISTRIBUTION TEST REFERENCE

| DIAMETER (INCHES) | | | DISTANCE |
|---|---|---|---|
| X | Y | AVG (X,Y) | INCHES |
| 0.0028 | 0.0025 | 0.0026 | 0.2879 |
| 0.0013 | 0.0011 | 0.0012 | 0.1844 |
| | | Formulation C | |
| 0.0031 | 0.0029 | 0.003 | 0.1272 |
| 0.0027 | 0.0026 | 0.00265 | 0.0749 |
| 0.0023 | 0.0023 | 0.0023 | 0.0909 |
| 0.003 | 0.0025 | 0.00275 | 0.0999 |
| 0.0028 | 0.0024 | 0.0026 | 0.0254 |
| 0.0021 | 0.0017 | 0.0019 | 0.1222 |
| 0.002 | 0.002 | 0.002 | 0.1031 |
| 0.0024 | 0.002 | 0.0022 | 0.0983 |
| 0.0025 | 0.002 | 0.00225 | 0.0471 |
| 0.002 | 0.0019 | 0.00195 | 0.1059 |
| 0.0018 | 0.0017 | 0.00175 | 0.1657 |
| 0.0023 | 0.0028 | 0.00255 | 0.0916 |
| 0.0022 | 0.0025 | 0.00235 | 0.0891 |
| 0.004 | 0.0034 | 0.0037 | 0.1187 |
| 0.0034 | 0.0031 | 0.00325 | 0.119 |
| 0.0029 | 0.0028 | 0.00285 | 0.1346 |
| 0.0016 | 0.0017 | 0.00165 | 0.0998 |
| 0.0016 | 0.0021 | 0.00185 | 0.0924 |
| 0.002 | 0.0023 | 0.00215 | 0.1472 |
| 0.0019 | 0.002 | 0.00195 | 0.1242 |
| 0.0019 | 0.002 | 0.00195 | 0.0675 |
| 0.0024 | 0.0021 | 0.00225 | 0.0606 |
| 0.0024 | 0.002 | 0.0022 | 0.0921 |
| 0.0028 | 0.0026 | 0.0027 | 0.0685 |
| 0.003 | 0.0029 | 0.00295 | 0.085 |
| 0.0028 | 0.002 | 0.0024 | 0.0739 |
| 0.002 | 0.0021 | 0.00205 | 0.0695 |
| 0.0024 | 0.0023 | 0.00235 | 0.0998 |
| 0.0023 | 0.0024 | 0.00235 | 0.1202 |
| 0.0017 | 0.0012 | 0.00145 | 0.1172 |
| 0.0024 | 0.0023 | 0.0023 | 0.0977 |
| 0.0005 | 0.0005 | 0.0005 | 0.0293 |
| | | Formulation D | |
| 0.0024 | 0.0024 | 0.0024 | 0.0837 |
| 0.0022 | 0.0015 | 0.00185 | 0.3021 |
| 0.0028 | 0.0026 | 0.0027 | 0.1093 |
| 0.0028 | 0.0026 | 0.0027 | 0.4007 |
| 0.0022 | 0.0026 | 0.0024 | 0.1238 |
| 0.002 | 0.002 | 0.002 | 0.098 |
| 0.0027 | 0.0026 | 0.00265 | 0.095 |
| 0.0022 | 0.0021 | 0.00215 | 0.0687 |
| 0.0002 | 0.0017 | 0.00095 | 0.1943 |
| 0.0023 | 0.0024 | 0.00235 | 0.1623 |
| 0.0023 | 0.002 | 0.00215 | 0.3233 |
| 0.0035 | 0.0033 | 0.0034 | 0.1076 |
| 0.0024 | 0.0028 | 0.0026 | 0.1002 |
| 0.002 | 0.0022 | 0.0021 | 0.1139 |
| 0.0024 | 0.0021 | 0.00225 | 0.1552 |
| 0.0017 | 0.0015 | 0.0016 | 0.0989 |
| 0.0018 | 0.0017 | 0.00175 | 0.0731 |
| 0.0026 | 0.0025 | 0.00255 | 0.1034 |
| 0.002 | 0.0023 | 0.00215 | 0.2965 |
| 0.0017 | 0.0016 | 0.00165 | 0.1002 |
| 0.0018 | 0.0015 | 0.00165 | 0.0815 |
| 0.0029 | 0.0024 | 0.00265 | 0.0971 |
| 0.003 | 0.0025 | 0.00275 | 0.0932 |
| 0.0025 | 0.0024 | 0.00245 | 0.0762 |
| 0.0024 | 0.0021 | 0.00225 | 0.1054 |
| 0.0018 | 0.0016 | 0.0017 | 0.0839 |
| 0.003 | 0.0027 | 0.00285 | 0.0489 |
| 0.002 | 0.0023 | 0.00215 | 0.1338 |
| 0.002 | 0.0014 | 0.0017 | 0.078 |
| 0.0032 | 0.0025 | 0.00285 | 0.1086 |
| 0.0023 | 0.0022 | 0.0022 | 0.1339 |
| 0.0006 | 0.0005 | 0.0005 | 0.0836 |

ARC PERFORATED PVA PACKET LEAKAGE TEST EVALUATION

Loose Load Vibration Test

Dissolving Test

Background Information

All polyvinyl alcohol (PVA) packets were water misted while exiting the packaging equipment. The purpose of water misting is to eliminate the air inside the packet. The present invention, arc perforation of the film, provides a viable alternative to misting.

Objective

To determine if the product will leak through the holes in the film that were made during the arc perforation process. (Note: The control for this test is the water misted packets.)

| SAMPLE DESCRIPTION Formulations | |
|---|---|
| Raw Material | wt - % |
| **A** | |
| Sodium Carbonate | 6.50 |
| Silicone dioxide | 2.00 |
| Sodium Sulfate | 45.14 |
| Sulfamic acid | 45.00 |
| Inerts Balance to | 100.00 |
| **B** | |
| Sodium sesquicarbonate | 10.00 |
| Silicone bicarbonate | 21.30 |
| Citric acid | 12.00 |
| Ethylene oxide/Propylene oxide alcohol ethoxylate | 2.00 |
| Sodium tripolyphosphate | 6.00 |
| Sodium laurylsulfate | 12.00 |
| Sodium carbonate | 18.00 |
| Linearalkyl sulfonate | 7.00 |
| Sodium xylene sulfonate | 6.00 |
| Silicon dioxide | 1.70 |
| $C_{14}$ aliphatic amine oxide | 4.00 |
| | 100.00 |
| **C** | |
| Sodium Carbonate | 76.05 |
| Linear alkyl sulfonate | 3.45 |
| Versene | 1.90 |
| Nonyl phenol ethoxylate | 15.20 |
| Balance: fragrances and dyes to | 100.00 |
| **D** | |
| Sodium sulfate | 58.29 |
| Sodium carbonate | 1.80 |
| Alkyldimethylbenzyl-ammonium chloride | 19.20 |
| Urea | 19.20 |
| Octyl phenol ethoxylate | 0.45 |
| Balance: fragrances and dyes to | 100.00 |

Film Material Description

| | FORMULATIONS | | | |
|---|---|---|---|---|
| | A | B | C | D |
| Film: | Monosol 7030 | Monosol 7030 | Monosol 7030 | Monosol 7030 |
| Thickness: | 1.5 mil | 2 mil formed, 1.5 mil lid | 1.5 mil | 1.5 mil |
| Size: | ½ oz. | .7 oz. | ½ oz. | ½ oz. |

Test Variables

1) Water Misted Packets (control)
2) Arc Perforated Packets

Sample Description

Tub

Manufacturer: Airlite
Material: HDPE
Size: 12 oz.
Pigment: White
Markings: Airlite (Omaha, Neb.), 1241A Cover Manufacturer: Airlite
Material: HDPE
Pigment: White Test Procedures and Results Loose Load Vibration Test Equipment: MTS 840 Vibration Test System
Displacement: 1"
Test Orientation: Bottom
Frequency (Hz): 4.3
Dwell Time: 60 minutes
Sample Size: 6 tubs of each product per variable Comments:

The following is a key to the descriptions under the loose load vibration test results:

Good: No evidence of product/powder.
Minor: Noticeable trace of product on hands/tub.
Small Amount: Measurable amount of powder in bottom of tub.

Results:

| | Tub # | Water Misted Packets (control) | Arc |
|---|---|---|---|
| FORMULA D | 1 | Small hole in 1 packet in tub bottom. Powder residue on bottom. | Good. |
| | 2 | Good, no leakage. | Good. |
| | 3 | 7 specs of product in bottom of tub. Minor residue left on hands. | Good. |
| | 4 | Good. | Good. |
| | 5 | Slight, minor residue left on hands. | Good. |
| | 6 | Slight, minor residue left on hands. | Good. |

Note: Water misted packets were soft. Arc perforated packets were slightly harder than control.

Test Procedures and Results

Loose Load Vibration Test

Results:

| | Tub # | Water Misted Packets (control) | Arc |
|---|---|---|---|
| FORMULA C | 1 | Minor amount of powder on 6 packets. Small amount of | Good, no evidence on |

-continued

| Tub # | Water Misted Packets (control) | Arc |
|---|---|---|
| | powder in bottom of tub. | packets. |
| 2 | Minor amount of powder on 8 packets. Small amount of powder in bottom of tub. | Good, small amount on 1 packet. |
| 3 | Minor amount of powder on 5 packets. Very mall amount of powder in bottom of tub. | Good. |
| 4 | Minor amount of powder on 2 packets. Small amount of powder in bottom of tub. | Good. |
| 5 | Minor amount of powder on 5 packets. Small amount of powder in bottom of tub. | Good. |
| 6 | Minor amount of powder on 4 packets. Small amount of powder in bottom of tub. | Minor amount of powder on 3 packets. Small amount of powder in bottom of tub. |

Note: Water misted packets were soft prior to testing. The arc perforated packets were slightly harder than the water misted.

| | Tub # | Water Misted Packets (control) | Arc |
|---|---|---|---|
| FORMULA B | 1 | Product left residue on hands. | Product left small amount of residue on hands. |
| | 2 | Product left residue on hands. Small amount of powder in bottom of tub. | Good. |
| | 3 | Product left residue on hands. | Good. |
| | 4 | Product left residue on hands. | Product left small amount of residue on hands. |
| | 5 | Powder on packets. 1 packet had small hole. | 5 packets had powder on them. |
| | 6 | Powder on packets. Small amount of powder in bottom of tub. | 3 packets had powder on them. |

Test Procedures and Results

Loose Load Vibration Test

Results:

| | Tub # | Water Misted Packets (control) | Arc |
|---|---|---|---|
| FORMULA A | 1 | Good. | Good. |
| | 2 | Good. | Good. |
| | 3 | Good. | Good. |
| | 4 | 1 packet had slight powder residue. | Small amount of dye/powder in bottom of tub. |
| | 5 | Good. | Good. |
| | 6 | Good. | Good. |

Note: Dark spots in product.

Performance Evaluation

Dissolving Test

Equipment: Thermometer, Stop Watch, 500 mil Beaker

Conditioning: Ambient (73° F.)

Water Temperature: 100° F. +/−2° F.

Sample Size: 3 packets of each product

Procedure:

Using 6 Airlite tubs, pack 5–15 packets into each tub. Complete the vibration test. Use stop watch to record time when the packet breaks open. Record water temperature with the thermometer. Dissolve 3 packets (1 from each tub) of each product/variable.

Results:

| | Sample # | Temp. (F.) | Time (sec.) | Comments |
|---|---|---|---|---|
| D Water Misted (control) | 1 | 102.0 | 2.0 | Stayed on top |
| | 2 | 99.0 | 3.5 | Sank to bottom |
| | 3 | 100.0 | 2.3 | Stayed on top |
| | Average: | 100.3 | 2.6 | |
| D Arc Perforated | 1 | 101.0 | 2.1 | Stayed on top |
| | 2 | 100.8 | 2.5 | Sank to bottom |
| | 3 | 99.4 | 2.0 | Stayed on top |
| | Average: | 100.4 | 2.2 | |

Note: All packets opened on the formed side of the material.

| | Sample # | Temp. (F.) | Time (sec.) | Comments |
|---|---|---|---|---|
| C Water Misted (control) | 1 | 101.0 | 5.7 | Stayed on top |
| | 2 | 100.8 | 3.1 | Sank to bottom |
| | 3 | 101.6 | 3.9 | Stayed on top |
| | Average: | 101.1 | 4.2 | |
| C Arc Perforated | 1 | 98.4 | 3.7 | Stayed on top |
| | 2 | 100.8 | 3.9 | Stayed on top |
| | 3 | 100.2 | 2.7 | Stayed on top |
| | Average: | 99.8 | 3.4 | |

Note: All water misted packets opened on the formed side after flipping over. All the arc perforated packets opened on the formed side.

Performance Evaluation

Dissolving Test

Results:

| | Sample # | Temp. (F.) | Time (sec.) | Comments |
|---|---|---|---|---|
| B Water Misted (control) | 1 | 100.0 | 4.1 | Stayed on top |
| | 2 | 100.6 | 6.3 | Stayed on top |
| | 3 | 100.4 | 3.8 | Stayed on top |
| | Average: | 100.3 | 4.7 | |
| B Arc Perforated | 1 | 100.6 | 8.5 | Stayed on top |
| | 2 | 100.0 | 4.0 | Stayed on top |
| | 3 | 100.0 | 4.0 | Stayed on top |
| | Average: | 100.2 | 5.5 | |

Note: All packets opened on the formed side of the material. Particle by particle of product would fall from packet after initial opening.

| | Sample # | Temp. (F.) | Time (sec.) | Comments |
|---|---|---|---|---|
| A Water Misted (control) | 1 | 99.0 | 2.5 | Sank to bottom |
| | 2 | 99.0 | 1.7 | Sank to bottom |
| | 3 | 100.6 | 2.9 | Sank to bottom |
| | Average: | 99.5 | 2.4 | |
| A Arc Perforated | 1 | 100.6 | 2.6 | Sank to bottom |
| | 2 | 101.8 | 2.4 | Sank to bottom |
| | 3 | 99.0 | 1.7 | Sank to bottom |
| | Average: | 100.5 | 2.2 | |

Note: All water misted packets sank to bottom then they opened on the formed side of material. Product would fizz and bubbles would rise to top.

Test Summary and Comments

Loose Load Vibration Test

Formulation D: There was no loose powder seen on the arc perforation samples. With the misting process, there was powder residue on the packets after testing in addition to some powder in the bottom of the but.

Formulation C: There was no loose powder seen on the arc perforation samples. There was evidence of powder on the packets and some residue on the bottom of the tubs with all 6 samples of the water misted product.

Formulation B: There was evidence of powder on the packets in 4 of the 6 tubs in addition to excess powder in the bottom of the tub of the misted product. Some of the same observations were seen with the arc perforation samples, but fewer.

Formulation A: There were no noticeable difference between the water misted (control) and the arc perforation samples.

Dissolving Test

The average time for initial opening of the samples was as follows (in seconds):

| Product Samples | Water Misted (control) Samples | Arc Perforated |
|---|---|---|
| D | 2.6 sec. | 2.2 sec. |
| C | 4.2 sec. | 3.4 sec. |
| B | 4.7 sec. | 5.5 sec. |
| A | 2.4 sec. | 2.2 sec. |

Of the product tested (with the exception of B) on an average the packets opened slightly quicker when using the arc perforation method vs. using the water misted (control) method. When using the arc perforation method with the B samples, it opened an average of 0.8 seconds slower than the water misted (control) samples.

Test Summary and Comments

Comments

In conclusion, the packets performed better using the arc perforation method vs. the water misted method.

We claim:

1. A sealed, water soluble, detersire package comprising:

(a) a mono-layer, water soluble film container having uniform microscopic perforations of a diameter size of about 0.0005 to 0.125 in., a distance between column of perforations of about 0.5 to 12.0 in., a distance between perforations within a column of about 0.05 to 1.0 in., and a film wall thickness of about 0.5 to 5.0 mil, and (b) a use amount of cast solid, pelletized or particulate detersive composition contained within said container, wherein said composition is unable to pass through the perforations.

2. The package of claim 1, wherein the water soluble film container comprises a water soluble polymer selected from the group consisting of a polyvinyl alcohol, polyvinyl acetate, polyvinyl pyrrolidone or mixtures thereof.

3. The package of claim 2, wherein the water soluble polymer is polyvinyl alcohol, polyvinyl acetate or mixtures thereof.

4. The package of claim 2, wherein the water soluble polymer is polyvinyl alcohol.

5. The package of claim 4, wherein the polyvinyl alcohol polymer comprises a polyvinyl alcohol which is about 86 to 89% hydrolyzed.

6. The package of claim 4, wherein the polyvinyl alcohol polymer comprises a polyvinyl alcohol having a molecular weight of about 10,000 to 200,000.

7. The package of claim 1, wherein the detersive composition comprises an acid, a base or a source of active halogen.

8. The package of claim 1 which further comprises a moisture impervious outerwrap.

9. A sealed, water soluble, detersive package comprising:

(a) a mono-layer, water soluble film container having uniform microscopic perforations of a diameter size of about 0.001 to 0.004 in., a distance between column of perforations of about 0.5 to 12.0 in., a distance between perforations within a column of about 0.1 to 0.3 in., and a film wall thickness of about 1.0 to 2.0 mil., and (b) a use amount of a cast solid, pelletized or particulate detersive composition comprising a basic component within said container, wherein said composition is unable to pass through the perforations.

10. The package of claim 9, wherein the water soluble film container comprises a polyvinyl alcohol film.

11. The package of claim 10, wherein the polyvinyl alcohol film comprises a polyvinyl alcohol which is about 86 to 89% hydrolyzed and has a molecular weight of about 10,000 to 200,000.

12. The package of claim 9, which further comprises a moisture impervious outerwrap.

13. A sealed, water soluble detersive package comprising:

(a) a mono-layer, water soluble film container having uniform microscopic perforations of a diameter size of about 0.001 to 0.004 in., a distance between column of perforations of about 0.5 to 12.0 in., a distance between perforations within a column of about 0.1 to 0.3 in., and a film wall thickness of about 1.0 to 2.0 mil., and (b) a use amount of a cast solid, pelletized or particulate detersive composition comprising an acid component within said container, wherein said composition is unable to pass through the perforations.

14. The package of claim 13, wherein the water soluble film container comprises a polyvinyl alcohol film.

15. The package of claim 14, wherein the poll/vinyl alcohol film comprises a polyvinyl alcohol which is about 86 to 89% hydrolyzed and has a molecular weight of about 10,000 to 200,000.

16. The package of claim 13, which further comprises a moisture impervious outerwrap.

17. A sealed, water soluble detersive package comprising:

(a) a mono-layer, water soluble film container having uniform microscopic perforations of a diameter size of about 0.001 to 0.004 in., a distance between column of perforations of about 0.5 to 12.0 in., a distance between perforations within a column of about 0.1 to 0.3, and a film wall thickness of about 1.0 to 2.0 mil., and (b) a use amount of a cast solid, pelletized or particulate detersive composition comprising a source of active halogen within said container, wherein said composition is unable to pass through the perforations.

18. The package of claim 17, wherein the water soluble film container comprises a polyvinyl alcohol film.

19. The package of claim 18, wherein the polyvinyl alcohol film comprises a polyvinyl alcohol which is about 86 to 89% hydrolyzed and has a molecular weight of about 10,000 to 200,000.

20. The package of claim 17, which further comprises a moisture impervious outerwrap.

* * * * *

UNITED STATES PATENT AND TRADEMARK OFFICE
CERTIFICATE OF CORRECTION

PATENT NO. : 5,534,178 PAGE 1 of 4

DATED : July 9, 1996

INVENTOR(S) : Bailly et al.

It is certified that error appears in the above-identified patent and that said Letters Patent is hereby corrected as shown below:

Item [57],
Title page, Abstract, line 3, please delete "detersire" and substitute therefore --detersive--

Title page, Abstract, line 8, please delete "detersire" and substitute therefore --detersive--

On column 1, line 10, please delete "detersire" and substitute therefore --detersive--

On column 1, line 35, please delete "detersire" and substitute therefore --detersive--

On column 1, line 54, please delete "detersire" and substitute therefore --detersive--

On column 7, line 45, please delete "detersire" and substitute therefore --detersive--

On column 7, line 47, please delete "detersire" and substitute therefore --detersive--

On column 7, line 53, please delete "detersire" and substitute therefore --detersive--

UNITED STATES PATENT AND TRADEMARK OFFICE
CERTIFICATE OF CORRECTION

PATENT NO. : 5,534,178

DATED : July 9, 1996

INVENTOR(S) : Bailly et al.

It is certified that error appears in the above-identified patent and that said Letters Patent is hereby corrected as shown below:

On column 8, line 33, please delete "detersire" and substitute therefore --detersive--

On column 8, line 39, please delete "detersire" and substitute therefore --detersive--

On column 8, line 43, please delete "detersire" and substitute therefore --detersive--

On column 8, line 45, please delete "detersire" and substitute therefore --detersive--

On column 8, line 48, please delete "detersire" and substitute therefore --detersive--

On column 8, line 51, please delete "detersire" and substitute therefore --detersive--

On column 10, line 28, please delete "detersire" and substitute therefore --detersive--

On column 10, line 39, please delete "detersire" and substitute therefore --detersive--

UNITED STATES PATENT AND TRADEMARK OFFICE
CERTIFICATE OF CORRECTION

PATENT NO. : 5,534,178

DATED : July 9, 1996

INVENTOR(S) : Bailly et al.

It is certified that error appears in the above-identified patent and that said Letters Patent is hereby corrected as shown below:

On column 10, line 49, please delete "detersire" and substitute therefore --detersive--

On column 10, line 52, please delete "detersire" and substitute therefore --detersive--

On column 10, line 67, please delete "detersire" and substitute therefore --detersive--

On column 11, line 12, and 13, please delete "detersire" and substitute therefore --detersive--

On column 12, line 8, please delete "detersire" and substitute therefore --detersive--

On column 7, line 42, please delete "Detersire" and substitute therefore --Detersive--

On column 8, line 29, please delete "Detersire" and substitute therefore --Detersive--

UNITED STATES PATENT AND TRADEMARK OFFICE
CERTIFICATE OF CORRECTION

PATENT NO. : 5,534,178

PAGE 4 of 4

DATED : July 9, 1996

INVENTOR(S) : Bailly et al.

It is certified that error appears in the above-identified patent and that said Letters Patent is hereby corrected as shown below:

On column 10, line 66, please delete "desraining" and substitute therefore --destaining--

On column 21, line 38 (claim 1), please delete "detersire" and substitute therefore --detersive--

On column 22, line 38 (claim 15), please delete "poll/vinyl" and substitute therefore --polyvinyl--

Signed and Sealed this

Fourteenth Day of January, 1997

Bruce Lehman

*Attest:*

BRUCE LEHMAN

*Attesting Officer*

*Commissioner of Patents and Trademarks*